US006682880B2

(12) United States Patent
Kuse

(10) Patent No.: US 6,682,880 B2
(45) Date of Patent: Jan. 27, 2004

(54) METHOD FOR PREPARING KIT PART FOR BLEACH-FIXING SOLUTION AND KIT FOR BLEACHING SOLUTION FOR USE IN SILVER HALIDE COLOR PHOTOGRAPHIC MATERIAL AND METHOD FOR PROCESSING SILVER HALIDE COLOR PHOTOGRAPHIC MATERIAL

(75) Inventor: Satoru Kuse, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/115,608

(22) Filed: Apr. 3, 2002

(65) Prior Publication Data

US 2003/0087207 A1 May 8, 2003

(30) Foreign Application Priority Data

Apr. 9, 2001 (JP) ..... 2001-109800

(51) Int. Cl.[7] ..... G03C 7/42
(52) U.S. Cl. ..... 430/450

(58) Field of Search ..... 430/450, 460, 430/461

(56) References Cited

U.S. PATENT DOCUMENTS

| | | | | |
|---|---|---|---|---|
| 5,521,056 A | | 5/1996 | Buchanan et al. | |
| 5,635,341 A | * | 6/1997 | Yamashita et al. | 430/393 |
| 5,652,085 A | * | 7/1997 | Wilson et al. | 430/393 |
| 5,679,817 A | | 10/1997 | Sakai et al. | |

* cited by examiner

*Primary Examiner*—Hoa Van Le
(74) *Attorney, Agent, or Firm*—Frishauf, Holtz, Goodman & Chick, P.C.

(57) ABSTRACT

A method for preparing a kit part of a bleach-fixing solution or a kit of a bleaching solution for use in silver halide color photographic materials is disclosed, comprising (a) adding a [S,S]-alkylenediamine-N,N'-disuccinic acid or its salt into a mixing tank to form a solution, and then, (b) adding thereto at least one iron (III) salt selected from the group consisting of iron (III) nitrate, iron (III) chloride, iron (III) bromide, $(M_1)_3Fe(III)(SO_4)_3$ and $M_1Fe(III)(SO_4)_2$.

18 Claims, No Drawings

METHOD FOR PREPARING KIT PART FOR BLEACH-FIXING SOLUTION AND KIT FOR BLEACHING SOLUTION FOR USE IN SILVER HALIDE COLOR PHOTOGRAPHIC MATERIAL AND METHOD FOR PROCESSING SILVER HALIDE COLOR PHOTOGRAPHIC MATERIAL

FIELD OF THE INVENTION

The present invention relates to a method for preparing a kit part used for a bleach-fixing solution and a kit used for a bleaching solution for silver halide color photographic light sensitive materials and a method for processing silver halide color photographic light sensitive materials by the use thereof.

BACKGROUND OF THE INVENTION

The method for obtaining color photographic images is commonly comprised of a process of forming dye images obtained through color development and a process of removing metallic silver formed together with the dye images from a silver halide color photographic material, a so-called desilvering process. The desilvering process is a step of processing a developed silver halide color photographic material with a bleaching solution containing halide ions and an oxidizing agent to cause formed metallic silver to be changed to silver halide, followed by processing with a fixing solution containing a silver halide solvent to remove the silver halide formed by bleaching as well as any remaining unexposed and undeveloped silver halide. There is also known a process of conducting bleaching and fixing in a single solution, a so-called bleach-fixing solution.

Potassium hexacyanoferrate (III), so-called red prussiate and ferric chloride have been hitherto employed as a bleaching agent. However, the use thereof has been limited in view of environmental concern and corrosion of equipments, and at present, (ethylenediaminetetraacetato)iron (III) complex and (1,3-propylenediaminettraacetato)iron (III) complex are broadly employed from the viewpoint of bleaching ability and economic reasons. However, (ethylenediaminetetraacetato)iron (III) complex and (1,3-propylenediaminettraacetato)iron (III) complex are difficult to initiate microbiological degradation and the use thereof produces problems from the point of view of global environmental protection. Recently, specifically in German, studies of a rule for limiting discharge of hardly degradable chelating agents to rivers and drains have been made, so that there is desired development of a photographic bleaching agent to overcome such problems.

In such a situation, development of biodegradable bleaching agents was made, including, for example, a technique of using iron (III) complexes of monoaminoalkylcarboxylic acid derivatives described in JP-A No. 7-181655 (hereinafter, the term, JP-A refers to Japanese Patent Application published for public inspection) and a technique of using alkylenediamine-N,N'-disuccinic acid iron (III) complex salts as a bleaching agent, as described in JP-A Nos. 4-313752 and 5-72695. However, it was proved that the foregoing iron (III) complexes of monoaminoalkylcarboxylic acid derivatives were insufficient in bleaching ability and the use of alkylenediamine-N,N'-disuccinic acid iron (III) complex salts produced difficulties with respect to their costs and stability.

To overcome such problems was proposed a technique, in which alkylenediamine-N,N'-disuccinic acid was made to react with (A) ammonia or an alkali metal hydroxide and (B) iron hydroxide in an aqueous solution, followed by oxidation of the reaction product, as described in JP-A No. 7-291984; a method of preparing an aminopolycarboxylic acid iron (III) complex, in which a peroxo-compound was added to an aqueous solution containing an aminopolycarboxylic acid iron (II) complex and ammonia to cause oxidation thereof, as described in JP-A 7-2745; and a method of ethylenediamine-N,N'-disuccinic acid meso-form iron (III) complex, in which triiron tetraoxide was added to an isomer mixture of a meso form and a racemic form of ethylenediamine-N,N'-disuccinic acid to cause to perform a heating reaction. However, such proposals were still insufficient. For example, oxidation by using air or a peroxo-compound or heating reaction during the preparation process caused decomposition of alkylenediamine-N,N'-disuccinic acid to produce impurities, producing problems in that precipitates were formed or the silver-bleaching ability of a silver halide photographic material was adversely affected, so that new technical developments are still being sought.

SUMMARY OF THE INVENTION

Accordingly, it is a first object of the present invention to provide a method for preparing a kit part of a bleach-fixing solution and a bleaching solution for use in silver halide color photographic materials, with minimized impurities and without adversely affecting photographic performance, and a method of processing a silver halide color photographic material by the use thereof.

It is a second object of the invention to provide a method for preparing a kit part of a bleach-fixing solution and a bleaching solution for use in silver halide color photographic materials, without forming precipitates or crystals after aging, while exhibiting superior storage stability, and a method of processing a silver halide color photographic material by the use thereof.

It is a third object of the invention to provide a method for preparing a kit part of a bleach-fixing solution and a bleaching solution for use in silver halide color photographic materials, resulting in an enhanced yield and exhibiting superior economic feasibility, and a method of processing a silver halide color photographic material by the use thereof.

The foregoing objects of the invention were accomplished by the following constitution:

1. A method for preparing a kit part of a bleach-fixing solution for use in silver halide color photographic materials, the method comprising the steps of:
   adding a [S,S]-alkylenediamine-N,N'-disuccinic acid or its salt into a mixing tank to form a solution thereof, and then
   adding thereto at least one iron (III) salt selected from the group consisting of iron (III) nitrate, iron (III) chloride, iron (III) bromide, $(M_1)_3Fe(SO_4)_3$ and $M_1Fe(SO_4)_2$, in which $M_1$ represents an ammonium, potassium, sodium or hydrogen atom, while maintaining the solution at 35 to 80° C.; and
2. A method for preparing a kit of a bleaching solution for use in silver halide color photographic materials, the method comprising the steps of:
   adding a [S,S]-alkylenediamine-N,N'-disuccinic acid or its salt into a mixing tank to form a solution thereof, and then
   adding thereto at least one iron (III) salt selected from the group consisting of iron (III) nitrate, iron (III), chloride, iron (III) bromide, $(M_1)_3Fe(SO_4)_3$ and $M_1Fe(SO_4)_2$, in which $M_1$ represents an ammonium, potassium, sodium or hydrogen atom, while maintaining the solution at 35 to 80° C.

Furthermore, preferred embodiments of the invention are as follows:

3. The method as described in 1 or 2 above, wherein the solution added with the [S,S]-alkylenediamine-N,N'-disuccinic acid or its salt into a mixing tank exhibits a pH of 6 to 10;
4. The method as described in 1, 2 or 3 above, wherein the kit part of a bleach-fixing solution or the kit of a bleaching solution each exhibit a pH of 3.5 to 6.0;
5. The method as described in any of 1 through 4 above, wherein the kit part of a bleach-fixing solution or the kit of a bleaching solution contains a compound represented by the following formula (1):

$$MOOC—(Z)_k—(X)_n \qquad \text{formula (1)}$$

wherein X represents $—COOM_2$, —OH, $—SO_3M_3$ or $—PO_3M_4M_5$; M, and $M_2$ through $M_5$ each represent an alkali metal or a hydrogen atom; n is an integer of 1 to 3, provided that when n is 2 or more, plural Xs may be the same or different; Z represents a (n+1)-valent linking group having 1 to 10 carbon atoms and comprising carbon(s) and hydrogen atom(s), or carbon atom(s), hydrogen atom(s) and oxygen atom(s); and k is 0 or 1;

6. The method as described in any of 1 through 5 above, wherein the kit part of a bleach-fixing solution or the kit of a bleaching solution contains an alkylenediamine-N-monosuccinic acid or its salt;
7. The method as described in any of 1 through 6 above, wherein after adding the iron (III) salt, stirring is performed in the mixing tank by propeller stirring or circulation stirring, wherein the propeller stirring is performed using a rotary blade having a turning radius of not less than ¼ of the radius of the mixing tank at a stirring rate of 50 to 120 r.p.m, and the circulation stirring being performed at a circulation rate of 2.0 to 5.5 cycles/min;
8. The method as described in any of 1 through 7 above, wherein the molar ratio of the [S,S]-alkylenediamine-N,N'-disuccinic acid or its salt to the iron (III) salt is 1.00 to 1.10;
9. A method of processing a silver halide color photographic material by the use of a kit part of a bleach-fixing solution prepared by the method as described in 1 or any of 3 through 8 above, or by the use of a kit of a bleaching solution prepared by the method as described in 2 or 3 through 8 above.

DETAILED DESCRIPTION OF THE INVENTION

In the method for preparing a kit part of a bleach-fixing solution for use in silver halide color photographic materials (hereinafter, also denoted as a kit part of a bleach-fixing solution relating to the invention) or a kit of a bleaching solution for use in silver halide color photographic materials (hereinafter, also denoted as a kit of a bleaching solution relating to the invention), one aspect of the invention concerns the use of a [S,S]-alkylenediamine-N,N'-disuccinic acid or its salt.

The [S,S]-alkylenediamine-N,N'-disuccinic acid or its salt relating to the invention is preferably a compound represented by the following formula (A):

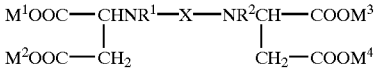

formula (A)

wherein $M^1$, $M^2$, $M^3$ and $M^4$ each represent a hydrogen atom, an alkali metal or a cation such as ammonium; X represents an alkylene group having 2 to 6 carbon atoms, which may be substituted, or $—(B_1O)_n—B_2—$, in which n is an integer of 1 to 6, $B_1$ and $B_2$ which may be the same or different are each an alkylene group having 1 to 5 carbon atoms; $R^1$ and $R^2$ each represent a hydrogen atom or an alkyl group having 1 to 3 carbon atoms.

Preferred examples of [S,S]-alkylenediamine-N,N'-disuccinic acid or its salt used in the invention are shown below, but the invention are by no means limited to these.

A-1

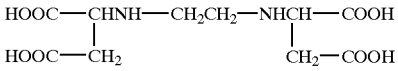

A-2

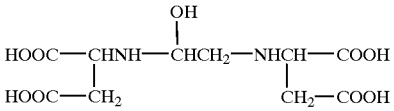

A-3

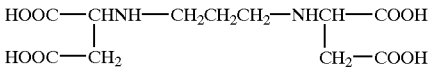

A-4

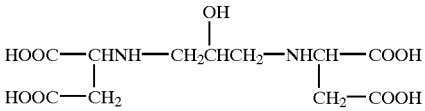

A-5

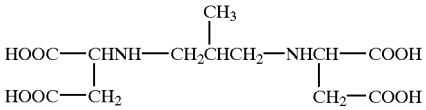

A-6

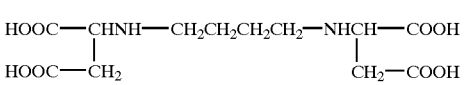

A-7

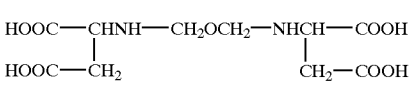

A-8

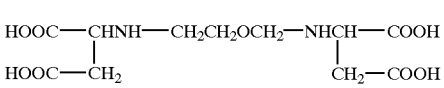

A-9

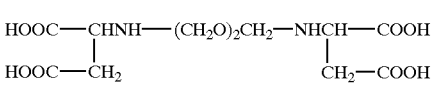

A-10

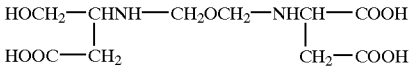

A-11

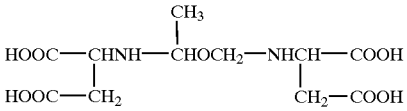

A-12

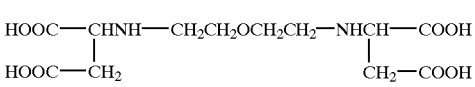

-continued

A-13

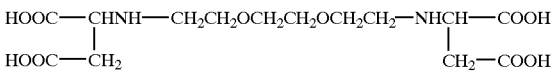

A-14

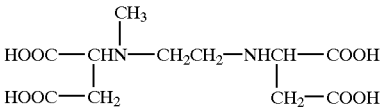

A-15

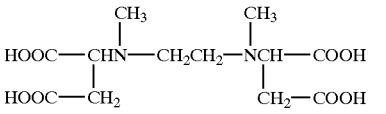

Any of the foregoing compounds is a [S,S]-isomer (optical isomer). Of these, compounds (A-1), (A-3) and (A-12) are preferred. The foregoing exemplified compounds are each represented by an acidic form but their salts (such as ammonium, potassium or sodium salts) are also usable in the invention.

In the method for preparing a kit part of a bleach-fixing solution or a kit of a bleaching solution, another aspect of the invention concerns the use of at least one iron (III) salt [hereinafter, also referred to as a ferric salt] selected from the group consisting of iron (III) nitrate (or ferric nitrate), iron (III) chloride (or ferric chloride), iron (III) bromide (or ferric bromide), and compounds represented by general formulas of $3M_1.Fe(III)(SO_4)_3$ and $M_1.Fe(III)(SO_4)_2$, in which $M_1$ represents an ammonium, potassium, sodium or hydrogen atom. As an iron (III) salt relating to the invention can be used a compound selected from the iron (III) salts described above and exemplary examples thereof include iron (III) nitrate, iron (III) chloride, iron (III) bromide, triammonium iron (III) trisulfate, tripotassium iron (III) trisulfate, trisodium iron (III) trisulfate, potassium iron (III) sulfate, sodium iron (III) sulfate, and ammonium iron (III) sulfate.

In the method for preparing a kit part of a bleach-fixing solution or a kit of a bleaching solution according to the invention, the above-described [S,S]-alkylenediamine-N,N'-disuccinic acid or its salt is added into a mixing tank containing mother liquor (such as water) to form a solution, and at least one of the iron (III) salts described above is further added thereto subsequently.

In one preferred embodiment of the invention, the solution prepared by adding a [S,S]-alkylenediamine-N,N'-disuccinic acid or its salt into the mixing tank is adjusted so as to exhibit a pH of 6 to 10. Adjusting the pH of the solution to the foregoing range results in further enhanced effects of the invention. Specifically, the pH is more preferably 7 to 8.5.

In one preferred embodiment of the invention, the pH of a kit part of a bleach-fixing solution and the pH of a kit of a bleaching solution are each within the range of 3.5 to 6.0, thereby achieving further enhanced effects of the invention more suitably. The pH of 4.0 to 5.5 is more preferred.

In one embodiment of the invention, i.e., in the preparation method of a kit part of a bleach-fixing solution or a kit of a bleaching solution, an organic acid represented by the following formula (1) is employed:

$$MOOC—(Z)_k—(X)_n \qquad \text{formula (1)}$$

wherein X represents $—COOM_2$, —OH, $—SO_3M_3$ or $—PO_3M_4M_5$, in which $M_2$ through $M_5$ each represent an alkali metal or hydrogen atom; n is an integer of 1 to 3, provided that when n is 2 or more, plural Xs may be the same or different; Z represents a (n+1)-valent linking group having 1 to 10 carbon atoms and comprising carbon(s) and hydrogen atom(s), or carbon atom(s), hydrogen atom(s) and oxygen atom(s); and k is 0 or 1; M represents an alkali metal or a hydrogen atom.

Of the organic acids represented by the foregoing formula (1), an organic acid represented by the following formula (1-A) or (1-B) is preferred:

formula (1-A)

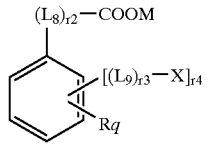

wherein $L_8$ and $L_9$ are each an alkylene group; r2 and r3 are each 0 or 1; r4 is an integer of 1 to 5; q is an integer of 0 to 4, provided that $r4+q \leqq 5$; and M is an alkali metal or a hydrogen atom;

$$X—(Y)_{r5}—COOM \qquad \text{formula (1-B)}$$

wherein Y is

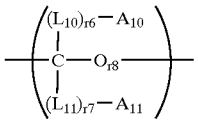

wherein $L_{10}$ and $L_{11}$ are each an alkylene group; r5 through r8 are each 0 or 1; $A_{10}$ and $A_{11}$ are each —H, —OH, $—COOM_1$, $—SO_3M_2$, or $—PO_3M_3M_4$, in which M and $M_1$ through $M_4$ are each an alkali metal or hydrogen atom.

Of the organic acids represented by the formula (1-B), specifically preferred compounds are those represented by the following formula ($1\text{-}B_1$) or ($1\text{-}B_2$)

$$MOOC—(CH_2)_{p6}—X \qquad \text{formula } (1\text{-}B_1)$$

$$MOOC—(CH_2)_{p7}—CH=CH—(CH_2)_{p8}—X \qquad \text{formula } (1\text{-}B_2)$$

wherein p6 is an integer of 0 to 6 and more preferably an integer of 2 to 4; P7 and p8 are each an integer of 0 to 3, and more preferably 0. It is specifically preferred that X be $—COOM_1$, and M and $M_1$ are each an alkali metal or a hydrogen atom.

Exemplary examples of the organic acid represented by formula (1) are shown below, but are by no means limited to these.

(1-1)

$HOOCCH_2C(OH)(COOH)CH_2COOH$ (1-2)

$HOOC(CHOH)_2COOH$ (1-3)

$HOOCCH_2COOH$ (1-4)

$HOOCCH(OH)CH_2COOH$ (1-5)

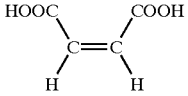

(1-6)

$HOOCCH_2CH_2COOH$

-continued (1-7) $(COOH)_2$ (1-8)

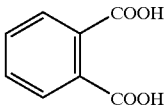

(1-9)

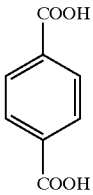

(1-10)

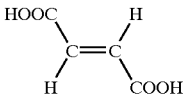

(1-11)

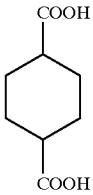

(1-12)

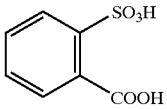

(1-13)

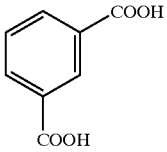

(1-14) $HOOC—(CH_2)_3—COOH$ (1-15) $HOOC—(CH_2)_4—COOH$ (1-16) $HOOCC{\equiv}CCOOH$ (1-17)

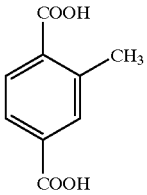

(1-18)

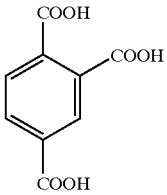

(1-19)

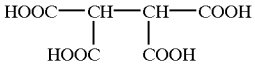

-continued (1-20)

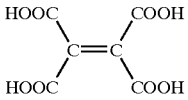

(1-21) $HO—CH_2—COOH$ (1-22) $HOOCCH_2—O—CH_2COOH$ (1-23)

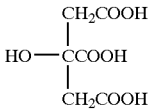

(1-24)

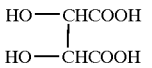

(1-25) $HOOC—CH_2—SO_3H$ (1-26) $HOOC(CH_2)_5COOH$ (1-27) $HOOC(CH_2)_6COOH$ (1-28)

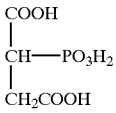

(1-29)

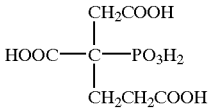

(1-30)

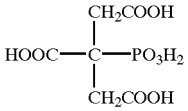

Preferred of the foregoing exemplified compounds are specifically compounds (1-5), (1-6), (1-10), (1-15), (1-21), (1-23) and (1-29). Examples of a salt of the acid described above include an ammonium salt, lithium salt, sodium salt and potassium salt; and sodium and potassium salts are preferable in terms of storage stability. The organic acids described above can be used alone or in combination thereof.

In one preferred embodiment of the invention, an alkylenediamine-N-monosuccinic acid or its salt is employed, thereby the objective effects of the invention can be achieved more suitably. The alkylenediamine-N-monosuccinic acid or its salt used in the invention is preferably a compound represented by the following formula (B):

formula (B)

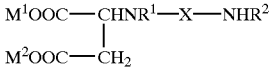

wherein $M^1$ and $M^2$ each represent a hydrogen atom, alkali metal atom or a cation such as ammonium; X represents an alkylene group having 2 to 6 carbon atoms, which may be substituted, or $—(B_1O)_n—B_2—$, in which n is an integer of 1 to 6 and $B_1$ and $B_2$, which may be the same or different, is an alkylene group having 1 to 5 carbon atoms; $R^2$ and $R^2$ are each a hydrogen atom or an alkyl group having 1 to 3 carbon atoms.

Preferred examples of the compound represented by the formula (B) are shown below.

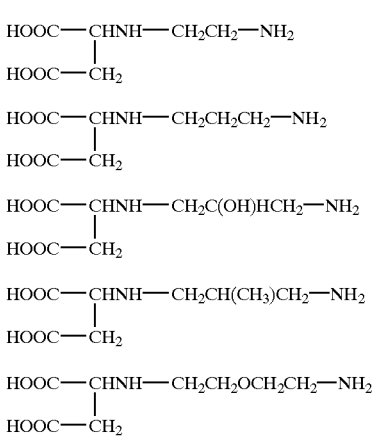

(B-1)

(B-2)

(B-3)

(B-4)

(B-5)

The foregoing exemplified compounds may be a [S,S]-form (optical isomer). Although the foregoing exemplified compounds are represented in the form of a free acid, they may be in the form of a salt of ammonium or any cation (such as sodium, potassium or lithium ion). Preferable of the foregoing compounds is specifically compound (B-1). The alkylenediamine-N-monosuccinic acid or its salt used in the invention is contained preferably in an amount of 0.05 to 2.0 mol/l.

In one preferred embodiment of the invention, the preparation method of a kit part of a bleach-fixing solution or a bleaching solution kit is characterized in that at least after adding the ferric salt, stirring within the mixing tank is carried out by means of propeller stirring or circulation stirring, wherein the propeller stirring is performed using a rotary blade having a turning radius not less than ¼ of the radius of the mixing tank at a stirring rate of 50 to 120 r.p.m and the circulation stirring being performed at a circulating speed of 2.0 to 5.5 cycles/min, and whereby the intended effects of the invention can be suitably achieved. Further, it is specifically preferred that the rotary blade used in the propeller stirring preferably have a turning radius of ⅓.5to ½of the mixing tank radius and be rotated at a rate of 60 to 100 r.p.m., or the circulation stirring be performed at a circulating speed of 2.5 to 4.5 cycle/min, thereby, the intended effects of the invention can be suitably achieved. Herein the turning radius is a length of from the rotation center to the top of the blade. In cases where the mixing tank is not circular, the radius of the tank is defined as a radius of a circle inscribing the wall of the tank.

Furthermore, after adding a [S,S]-alkylenediamine-N,N'-disuccinic acid or its salt into the mixing tank to form a solution, the iron (III) salt of the invention is added to the solution maintained at a temperature of 35 to 80° C. (preferably 40 to 70° C.). It was proved that precipitation easily occurred at a temperature lower than 35° C. during the addition of the iron salt and in the case of a temperature higher than 80° C., silver retention occurred at the time of processing.

In one preferred embodiment of the invention, the preparation method of a kit part of a bleach-fixing solution or a bleaching solution kit is characterized in that the molar ratio of a [S,S]-alkylenediamine-N,N'-disuccinic acid or its salt to an iron (III) salt is 1.00 to 1.10, whereby the intended effects of the invention can suitably be achieved. To more suitably achieve the intended effects of the invention is specifically preferred the molar ratio of 1.00 to 1.05. The [S,S]-alkylenediamine-N,N'-disuccinic acid (or its salt) and iron (III) salt are each contained preferably in an amount of 0.05 to 2.0 mol/l.

In the kit part of a bleach-fixing solution or in the kit of a bleaching solution relating to the invention, the ammonium content is preferably 0 to 30 mol %, based on total cations contained therein, whereby the intended effects of the invention can be suitably achieved. The ammonium content is more preferably 0 to 10 mol % is, whereby odor is minimized and the intended effects of the invention can be more suitably achieved.

The kit part of a bleach-fixing solution or the bleaching solution kit relating to the invention may contain, in addition to the compounds described above, adjuvants such a halogenating agent, a bleaching agent, a bleach-accelerating agent, an alkaline agent, an acid, an anticorrosion agent and buffering agent. Exemplary examples thereof include ammonium bromide, potassium bromide, imidazole, acetic acid, ammonium nitrate, potassium nitrate, nitric acid, sulfuric acid and ammonia water as well as conventional additives used in bleach-fixing solutions and bleaching solutions.

In commonly used bleach-fixing solutions, a concentrated part containing a bleaching agent such as aminopolycarboxylic acid iron complex salt and a concentrated part containing a thiosulfate are used as plural kit parts in terms of storage stability and physical distribution. The kit part of a bleach-fixing solution relating to the invention is a kit part containing a bleaching agent, referring to a product form when really handed in to users. The kit of a bleaching solution (or bleaching solution kit) relating to the invention may be used as a single kit containing a bleaching agent, a halogenating agent and a buffering agent, or may be separated to plural kit parts, but in either of them, it is a kit containing a bleaching agent, referring to a product form at the time when really handed in to users.

EXAMPLES

The present invention will be further detailed based on examples but the invention are by no means limited to these examples.

Example 1

Preparation of Kit Part for Bleach-fixing Solution

Preparation of Sample Solution No. 1: Invention

To a mixing tank having a diameter of 1 m and provided with a propeller stirring apparatus having a stirring blade of 15 cm turning radius was added 250 lit. deionized water, subsequently, 500 moles of exemplified compound (A-1) was added with stirring at a stirring speed of 50 r.p.m. and 25 kg of 25% ammonia water was further added; after being completely dissolved, 490 moles of iron (III) nitrate nonahydrate was added thereto with stirring at a stirring speed of 75 r.p.m. and the pH was adjusted to 5.0 with 90% acetic acid or 25% ammonia water, followed by making the total amount 500 lit. After stirring was further continued for 2 hrs., the pH was again measured and in cases when the pH varied, the pH was again adjusted to 5.0 with 90% acetic acid or 25% ammonia water to obtain sample solution No. 1. From visual observation, the thus prepared sample solution No. 1 was a homogeneous solution containing no precipitate.

Preparation of Sample Solution No. 2: Comparison

In accordance with the method described in Example 1 of JP-A 7-291984, sample solution No. 2 was prepared similarly to sample solution No. 1, provided that in place of iron (III) nitrate nona-hydrate, 200 moles of triiron tetraoxide and 900 g of iron powder were added and reaction was performed at a temperature of 90 to 95° C. After cooling to 60° C. and removing insoluble iron oxide, air was blown into the reaction solution at a rate of 7 lit./min for 3 hrs. using a ball filter to perform an oxidation reaction, thereafter, the pH was adjusted to 6.0 using ammonia water to obtain sample solution No. 2.

Preparation of Sample Solution No. 3: Comparison

In accordance with the method described in Example 1 of JP-A 7-2745, sample solution No. 3 was prepared similarly to sample solution 1, provided that in place of iron (III) nitrate nona-hydrate, an equimolar amount of iron (II) sulfate hepta-hydrate was added and dissolved with heating and after being cooled to ordinary temperature, the pH was adjusted to 7.0 with 25% ammonia water. Subsequently, to the reaction solution was added ammonium persulfate in 1 hr. at room temperature with stirring at 50 r.p.m. and after performing an oxidation reaction, the pH was adjusted to 6.0 with sulfuric acid to obtain sample solution No. 3.

Preparation of Sample Solution No. 4: Comparison

In accordance with the method described in Example 1 of JP-A 10-168045, sample solution No. 4 was prepared similarly to sample solution 1, provided that in place of iron (III) nitrate nonahydrate, an equimolar amount of triiron tetraoxide was used and reaction was continued for 3 hrs at 60° C. and air was blown into the reaction solution at the same temperature to perform oxidation, thereafter, the reaction solution was filtered to obtain sample solution No. 4.

Evaluation of Bleach-fixing Solution

To evaluate the thus prepared kit parts for a bleach-fixing solution, color photographic paper was prepared in accordance with the following procedure.

Preparation pf Color Photographic Material Sample (Color Paper) for Evaluation

Preparation of Support

There was prepared 170 g/m$^2$ weight, 175 $\mu$m thick white raw paper comprised of 50% by weight of sulfate-bleached hardwood pulp (LBKP) and 50% by weight of sulfate-bleached softwood pulp (LBSP). Subsequently, clear polypropylene was melt-extruded at 300° C. and then subjected to biaxial stretching using a flat film method sequential biaxial-stretching apparatus to prepare biaxially stretched polypropylene resin sheet. Thereafter, melt-extruded polyethylene resin sheet was sandwiched between the foregoing white raw paper and resin sheet and nipped to form a laminated back resin layer.

Then, to form a laminated surface resin layer, a 5 $\mu$m thick melt-extruded polyethylene layer was provided on the opposite side to the back resin layer to form a laminated surface resin layer. Separately, 95% by weight of polypropylene and 5% by weight of anatase type titanium oxide were kneaded and meltingly extruded at 300° C. and then, 30 $\mu$m thick, biaxially stretched polypropylene resin sheet was prepared using a flat film method sequential biaxial-stretching apparatus. The thus prepared biaxially stretched polypropylene resin sheet was nipped onto the surface of the polyethylene resin layer described above to, form laminated resin layers to obtain a paper support.

The surface resin layer side of the thus obtained paper support was subjected to corona discharge (at an output current of 2 amp. and further thereon, a gelatin sublayer was coated at a gelatin coverage of 40 mg/M$^2$.

Coating of Photographic Component Layers

On the prepared paper support, component layers as shown below were successively coated to prepare a multi-layered silver halide color photographic material.

| Layer | Constitution | Amount (g/m$^2$) |
|---|---|---|
| 7th Layer (Protective layer) | Gelatin | 0.60 |
| 6th Layer (UV absorbing layer) | Gelatin | 0.30 |
| | UV absorbent (UV-1) | 0.10 |
| | UV absorbent (UV-2) | 0.04 |
| | UV absorbent (UV-3) | 0.18 |
| | Antistaining agent (HQ-1) | 0.01 |
| | DNP | 0.18 |
| | PVP | 0.03 |
| | Antiirradiation dye (AI-2) | 0.02 |
| 5th Layer (Red-sensitive layer) | Gelatin | 1.05 |
| | Red-sensitive silver bromo-chloride emulsion (Em C) by equivalent converted to silver | 0.13 |
| | Cyan coupler (C-1) | 0.20 |
| | Cyan coupler (C-2) | 0.22 |
| | Dye image stabilizer (ST-1) | 0.20 |
| | Antistaining agent (HQ-1) | 0.01 |
| | HBS-1 | 0.20 |
| | DOP | 0.20 |
| 4th Layer (UV absorbing layer) | Gelatin | 0.75 |
| | UV absorbent (UV-1) | 0.28 |
| | UV absorbent (UV-2) | 0.08 |
| | UV absorbent (UV-3) | 0.38 |
| | Antistaining agent (HQ-1) | 0.03 |
| | DNP | 0.30 |
| 3rd Layer (Green-sensitive layer) | Gelatin | 1.25 |
| | Green-sensitive silver bromo-chloride mulsion (Em B) by equivalent converted to silver | 0.12 |
| | Magenta coupler (M-C) | 0.30 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| | Antiirradiatiob dye (AI-1) | 0.02 |
| 2nd layer (Interlayer) | Gelatin | 1.10 |
| | Antistaining agent (HQ-2) | 0.12 |
| | DIDP | 0.15 |
| 1st layer (Blue-sensitive layer) | Gelatin | 1.15 |
| | Blue-sensitive silver bromo-chloride emulsion (Em A) by equivalent converted to silver | 0.18 |
| | Yellow coupler (Y-1) | 0.75 |
| | Dye image stabilizer (ST-1) | 0.30 |
| | Dye image stabilizer (ST-2) | 0.20 |
| | Antistaining agent (HQ-1) | 0.02 |
| | Antiirradiation dye (AI-3) | 0.02 |
| | DNP | 0.18 |

With regard to the method of preparing respective coating solutions used for preparing the foregoing sample, preparation of the 1st layer coating solution is exemplarily shown below.

Preparation of 1st Layer Coating Solution

Yellow coupler (Y-1) of 26.7 g, 100 g of dye image stabilizer (ST-1), 6.67 g of dye image stabilizer (ST-2) and 0.67 g of additive (HQ-1) were dissolved in 60 ml of ethyl acetate together with 6.67 g of high boiling solvent (DNP) and dispersed in 220 ml of an aqueous 10% gelatin solution containing 7 ml of 20% surfactant aqueous solution (SU-1 using an ultrasonic homogenizer to prepare a yellow coupler dispersion. The thus emulsified dispersion was mixed with a blue-sensitive silver halide emulsion (having a silver equivalent content of 10 g) to prepare the $_1$st layer coating solution.

Coating solutions for the 2nd to 7th layers were prepared similarly to the 1st layer coating solution described above. Hardening agent, (H-1) was added to the 2nd and 4th layers, and (H-2) was added to the 7th layer. As a coating aid, surfactants (SU-2) and (SU-3) were used to adjust the surface tension.

Additives used for preparing the foregoing sample are as follows.

Y-1

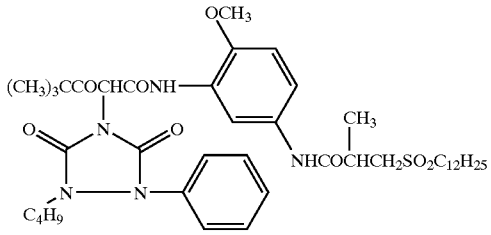

M-C

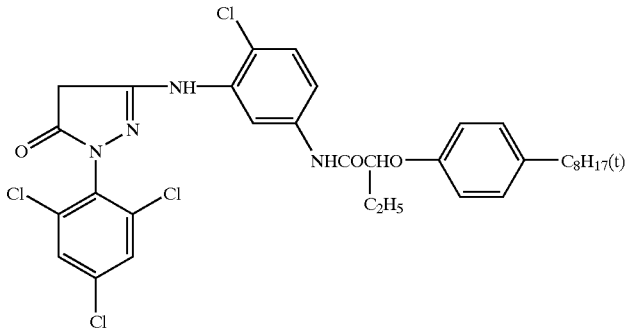

C-1

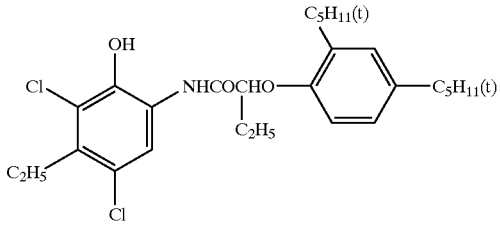

C-2

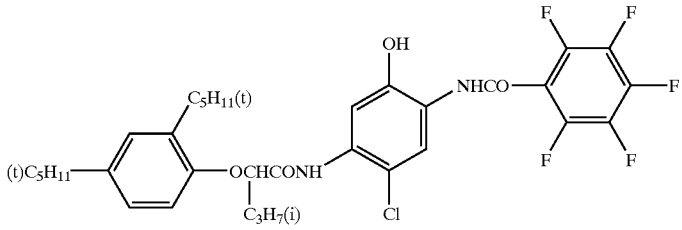

ST-1

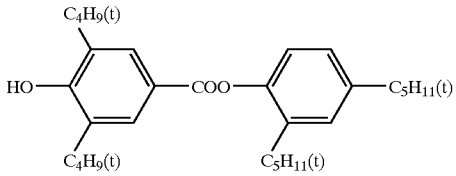

ST-2

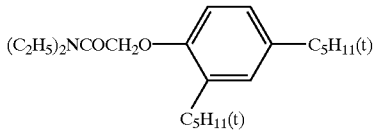

-continued
ST-3
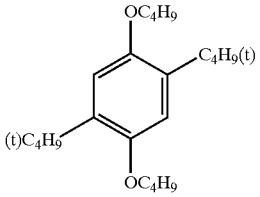
ST-4
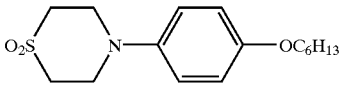
ST-5
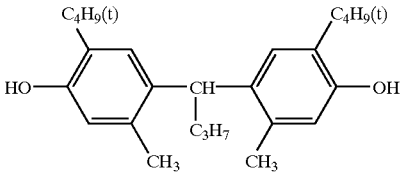
UV-1
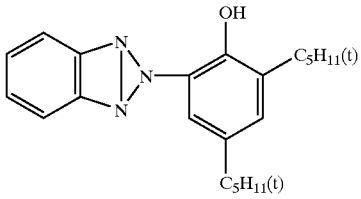
UV-2
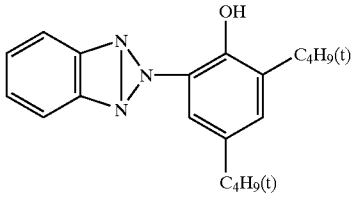
UV-3
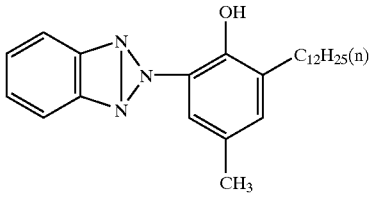
| | |
|---|---|
| DOP | Dioctyl phthalate |
| DNP | Dinonyl phthalate |
| DIDP | Diisodecyl phthalate |
| PVP | Polyvinyl pyrrolidine |
HQ-1
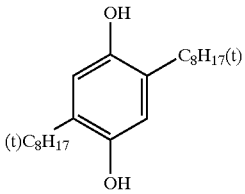

-continued
HQ-2
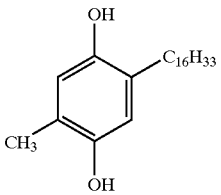
HBS-1
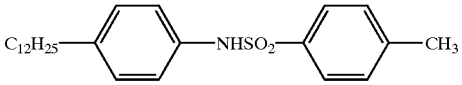
AI-1
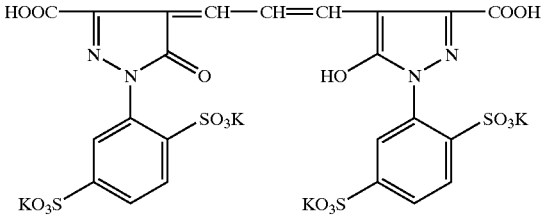
AI-2
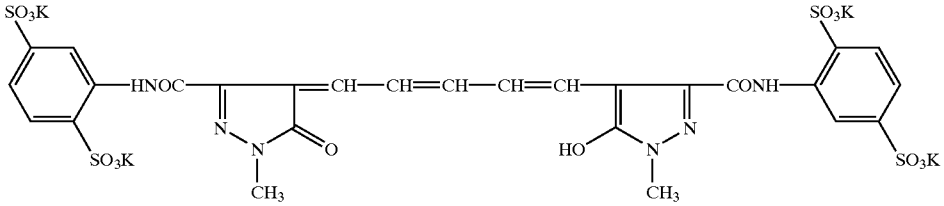
AI-3
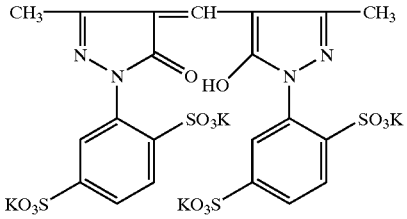
SU-1
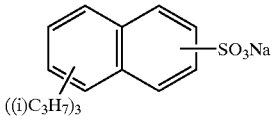
SU-2
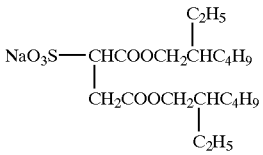
SU-3
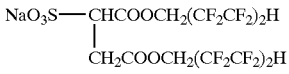
H-1 $C(CH_2SO_2CH{=}CH_2)_4$
H-2
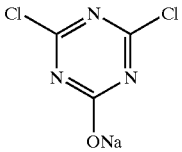

Preparation of silver halide emulsions used in the foregoing sample is described below.

Preparation of Blue-sensitive Silver Bromochloride Emulsion

To 1 liter of aqueous 2% gelatin solution kept at 40° C. were simultaneously added the following solutions (Solutions A and B) in 30 min., while being maintained at a pAg of 6.5 and pH of 3.0, and further thereto were added Solutions C1 and D1 in 180 min., while being maintained at a pAg of 7.3 and pH of 5.5. The pAg was controlled by the method described in JP-A 59-45437, and the pH was adjusted using aqueous sulfuric acid or sodium hydroxide solution.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| Potassium bromide | 1.0 g |
| Water to make | 600 ml |
| Solution D | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and re-dispersed in a gelatin aqueous solution to obtain a monodisperse cubic grain emulsion (EMP-1) having an average grain size of 0.85 μm, a coefficient of variation of grain size of 7% and a chloride content of 99.5 mol %.

The emulsion, EMP-1 was chemically sensitized at 50° C. for 90 min using the following compounds to obtain blue-sensitive silver bromochloride emulsion (Em A).

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green-sensitive Silver Bromochrolide Emulsion

Monodisperse cubic grain emulsions, EMP-2 having an average grain size of 0.43 μm, a variation coefficient of 8% and a chloride content of 99.5 mol % was prepared in the same manner as in preparation of EMP-1, except that an adding time of Solutions A and B, and that of Solution C and D were respectively varied.

The emulsion, EMP-2 was chemical-sensitized at 55° C. for 120 min. using the following compounds to obtain green-sensitive silver bromochloride emulsion (Em B).

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of Red-sensitive Silver Bromochloride Emulsion

Monodisperse cubic grain emulsion, EMP-3 having an average grain size of 0.50 μm, a variation coefficient of 8% and a chloride content of 99.5 mol % were prepared in the same manner as in preparation of EMP-1, except that an adding time of Solutions A and B, and that of Solution C and D were respectively varied.

Emulsion EMP-3 was chemically sensitized at 60° C. for 90 using the following compounds to obtain red-sensitive silver halide emulsion (Em C).

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $4 \times 10^{-4}$ mol/mol AgX |

BS-1

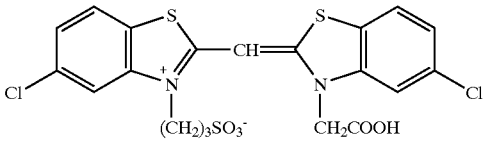

BS-2

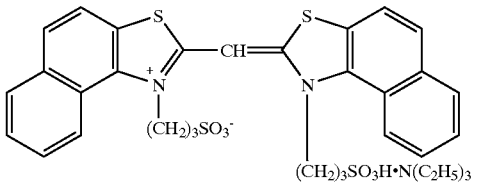

GS-1

-continued

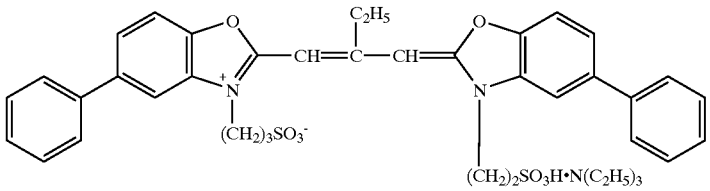

RS-1

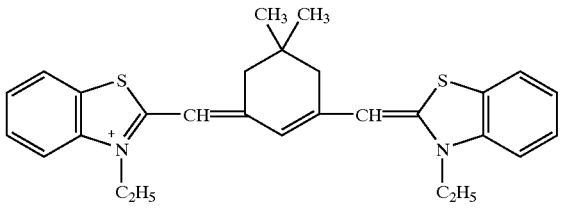

STAB-1

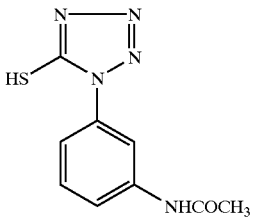

Exposure and Processing

In accordance with the conventional manner, the thus prepared photographic material sample was exposed through an optical wedge and subjected to each of processes 1-1 through 1-4 according to the following processing steps, using the following processing solutions, in which sample solution Nos. 1 through 4 were each used as a bleach-fixing solution.

Process

| Processing Step | Temperature | Time |
|---|---|---|
| (1) Color developing | 40.0 + 0.3° C. | 20 sec. |
| (2) Bleach-fixing | 38.0 + 0.3° C. | 15 sec. |
| (3) Stabilizing | 30 to 36° C. | 45 sec. (three-bath cascade) |
| (4) Drying | 60 to 80° C. | 20 sec. |

Preparation of Processing Solutions

| Color developing solution | |
|---|---|
| Water | 700 g |
| Diethylene glycol | 12 g |
| Triisopropanolamine | 8 g |
| N,N-disulfoethylhydroxylamine | 8 g |
| Sodium p-toluenesulfonate | 15 g |
| Potassium bromide | 10 mg |
| Sodium chloride | 3.0 g |
| Diethylenetriaminepentaacetic acid | 5 g |
| Potassium sulfite | 0.2 g |

-continued

| Color developing solution | |
|---|---|
| 3-Methyl-4-amino-N-ethyl-N-(β-methane-sulfonamidoethyl)-aniline sulfate | 8.0 g |
| Potassium carbonate | 26 g |
| Potassium hydrogen carbonate | 3.2 g |

Water was added to make the total volume of 1 lit. and the pH was adjusted to 10.20 using potassium hydroxide or sulfuric acid.

| Bleach-fixing solution | |
|---|---|
| Water | 300 g |
| Bleach-fixer kit part (Sample Solution No. 1 to 4, shown in Table 1) | 200 ml |
| Ammonium thiosulfate | 80 g |
| Ammonium sulfite | 12 g |

Water was added to make the total volume of 1 lit. and the pH was adjusted to 6.5 using 25% ammonia water or acetic acid.

| | |
|---|---|
| Water | 800 g |
| Benzisothiazoline-3-one | 0.2 g |
| Tinopal SFP (available from Ciba-Geigy Co.) | 1.0 g |
| Zinc sulfate heptahydrate | 0.1 g |
| 1-Hydroxyethylidene-1,1-diphosphonic acid | 2.0 g |
| Diethylenetriaminepentaacetic acid | 1.2 g |

Water was added to make the total volume of 1 lit. and the pH was adjusted to 7.5 with 25% ammonia water or acetic acid.

Evaluation of Processing Solution and Processed Sample

Evaluation of Bleaching Ability

After processing samples using the foregoing processing solutions, the amount of developed silver remained in the maximum density area of each of the processed samples was measured by a fluorescent X-ray analyzer (produced by RIGAKU DENKI KOGYO Co., Ltd.) to determine the residual silver amount (mg/dm$^2$).

Evaluation of Storage Stability of Bleach-fixing Solution

After completion of the foregoing processing, each of the bleach-fixing solutions was sealed in a glass container and allowed to stand at 50° C. for 3 days; thereafter, the bleach-fixing solutions each were visually observed with respect to occurrence of precipitation within the solution.

The thus obtained results are shown in Table 1.

TABLE 1

| Processing No. | Sample Solution | Residual Silver (mg/m$^2$) | Storage Stability | Remark |
|---|---|---|---|---|
| 1-1 | 1 | 0.0 | No precipitate | Inv. |
| 1-2 | 2 | 0.5 | Precipitates | Comp. |
| 1-3 | 3 | 0.7 | Precipitates | Comp. |
| 1-4 | 4 | 0.6 | Precipitates | Comp. |

As apparent from Table 3, it was proved that the use of a bleach-fixing solution, which was prepared using Sample solution No. 1 according to the invention, resulted in no retained silver in the processed sample and no precipitate in the aged bleach-fixing solution, leading to superior performance.

Example 2

Sample solution Nos. 2-1 through 2-8 of a bleach-fixing kit part were prepared similarly to Sample solution No. 1 of Example 1, except that after adding 250 lit. deionized water and 500 moles of exemplified compound (A-1) with stirring at a stirring speed of 50 r.p.m., the pH was adjusted to a value shown in Table 4, using 25% ammonia water and 90% acetic acid. Subsequently, exposure and processing were conducted similarly to Example 1, except that Sample solution Nos. 2-1 through 2-8 were each used as a bleach-fixing solution. Then, similarly to Example 1, the retained silver amount was more, after completion of the foregoing processing, each of bleach-fixing solutions was stirred at 40° C. for 2 hrs. and the state of each of the solutions was visually observed.

The thus obtained results are shown in Table 2.

TABLE 2

| Processing No. | Sample Solution | pH*1 | Residual Silver (mg/m$^2$) | State of Solution*2 |
|---|---|---|---|---|
| 2-1 | 2-1 | 5.0 | 0.7 | Some precipitates |
| 2-2 | 2-2 | 6.0 | 0.3 | No precipitate |
| 2-3 | 2-3 | 7.0 | 0.0 | No precipitate |
| 2-4 | 2-4 | 8.0 | 0.0 | No precipitate |
| 2-5 | 2-5 | 8.5 | 0.0 | No precipitate |

TABLE 2-continued

| Processing No. | Sample Solution | pH*1 | Residual Silver (mg/m$^2$) | State of Solution*2 |
|---|---|---|---|---|
| 2-6 | 2-6 | 9.0 | 0.3 | No precipitate |
| 2-7 | 2-7 | 10.0 | 0.4 | No precipitate |
| 2-8 | 2-8 | 11.0 | 0.6 | Some precipitates |

*1pH before adding iron(III) nitrate
*2The state of a bleach-fixing solution after being stirred for 2 hr.

As can be seen from Table 2, it was proved that bleach-fixing solutions, in which the pH was adjusted to 6 to 10 prior to the addition of ferric nitrate and the use thereof resulted in no precipitation and exhibiting superior bleaching ability. Specifically, superior results were achieved at the level of a pH of 7 to 8.5.

Example 3

Sample solution Nos. 3-1 through 3-7 of a bleach-fixing kit part were prepared similarly to Sample solution No. 1 of Example 1, except that instead of adjusting the pH 5.0 after the addition of a ferrate, the pH was adjusted to a value as shown in Table 5. The thus prepared sample solutions No. 3-through 3-7 were sealed in a thermoplastic resin vessel and aged at 50° C. for 1 week. After being aged, the state of each of the solutions was visually observed. Then, exposure and processing were conducted similarly to Example 1, except that the thus aged bleach-fixing solutions were used as a bleach fixing solution (Processing Nos. 3-1 through 3-7).

Similarly to Example 1, the thus processed samples were measured with respect to the residual silver amount. Results of the visual observation of aged solutions and the residual silver amount were shown in Table 3.

TABLE 3

| Processing No. | Sample Solution | pH*1 | Residual Silver (mg/m$^2$) | State of Solution*2 |
|---|---|---|---|---|
| 3-1 | 3-1 | 3.0 | 0.4 | Some precipitates |
| 3-2 | 3-2 | 3.5 | 0.2 | Very slight precipitates |
| 3-3 | 3-3 | 4.0 | 0.0 | No precipitate |
| 3-4 | 3-4 | 5.0 | 0.0 | No precipitate |
| 3-5 | 3-5 | 5.5 | 0.0 | No precipitate |
| 3-6 | 3-6 | 6.0 | 0.2 | Very slight precipitates |
| 3-7 | 3-7 | 7.0 | 0.6 | Some precipitates |

*1pH after adding a ferrate,
*2The state of a bleach-fixing solution after being aged at 50° C. for 1 week.

As apparent from Table 3, it was proved that bleach-fixing solutions, in which the pH after adding a iron (III) salt was within the range of 3.5 to 6.0 caused no or only very slight precipitation, and the use thereof led to superior bleaching ability. Specifically, sample solutions of a pH of 4.0 to 5.5 resulted in superior performance.

Example 4

Sample solutions Nos. 4-1 through 4-6 of a bleach-fixing kit part were prepared similarly to sample solution No. 3-2 of Example 3, except that in place of acetic acid, organic acids shown in Table 4 were used as a pH-adjusting agent. Similarly to Example 3, sample solutions were measured with respect to the state of aged solutions and the retained silver amount. Results thereof are shown in Table 4.

TABLE 4

| Processing No. | Sample Solution | Organic Acid | Residual Silver ($mg/m^2$) | State of Solution*1 |
|---|---|---|---|---|
| 4-1 | 4-1 | Acetic acid | 0.2 | Very slight precipitates |
| 4-2 | 4-2 | (1-5) | 0.0 | No precipitate |
| 4-3 | 4-3 | (1-6) | 0.0 | No precipitate |
| 4-4 | 4-4 | (1-15) | 0.1 | No precipitate |
| 4-5 | 4-5 | (1-21) | 0.2 | No precipitate |
| 4-6 | 4-6 | (1-29) | 0.1 | No precipitate |

*1The state of a bleach-fixing solution after being aged at 50° C. for 1 week.

As apparent from Table 4, it was proved that the use of the compound represented by formula (1) in place of acetic acid to adjust the pH achieved further enhanced effects of the invention. In addition thereto, the use of the compound of formula (1) caused substantially little odor, resulting in a superior working environment.

Example 5

Sample solutions Nos. 5-1 through 5-3 of a bleach-fixing kit part were prepared similarly to sample solution No. 3-2 of Example 3, except that a compound represented by formula (B), alkylenediaminemonosuccinic acid (hereinafter, also denoted simply as ADMS) as was added in an amount of 1/20 mol % of the compound (A-1). Similarly to Example 3, the state of aged sample solutions and retained silver amounts were evaluated. Results thereof are shown in Table 5.

TABLE 5

| Processing No. | Sample Solution | ADMS*1 | Residual Silver ($mg/m^2$) | State of Solution*2 |
|---|---|---|---|---|
| 5-1 | 5-1 | — | 0.2 | Very slight precipitates |
| 5-2 | 5-2 | (B-1) | 0.0 | No precipitate |
| 5-3 | 5-3 | (B-2) | 0.0 | No precipitate |

*1Alkylenediaminemonosuccinic acid
*2The state of a bleach-fixing solution after being aged at 50° C. for 1 week.

As apparent from Table 5, it was proved that the use of an alkylenediaminemonosuccinic acid in combination resulted in-further enhanced effects of the invention.

Example 6

Sample solutions No. 6-1 through 6-16 of a bleach-fixing kit part were prepared similarly to sample solution No. 1 of Example 1, except that the radius of a stirring blade provided in the mixing tank (which was expressed in terms of a ratio of the turning radius of the blade to the radius of the mixing tank) and the stirring rate after addition of a ferrate were each varied, as shown in Table 6. Similarly to Example 1, storage stability of sample solutions, i.e., occurrence of precipitation in the aged solutions and the retained silver amount were evaluated and the results thereof are shown in Table 6.

TABLE 6

| Processing No. | Sample Solution | Stirring Blade Radius* | Stirring Rate (r.p.m.) | Residual Silver ($mg/m^2$) | Storage Stability |
|---|---|---|---|---|---|
| 6-1 | 6-1 | 1/5 | 75 | 0.5 | Some precipitates |
| 6-2 | 6-2 | 1/4.5 | 75 | 0.3 | Very slight precipitates |
| 6-3 | 6-3 | 1/4 | 75 | 0.2 | No precipitate |
| 6-4 | 6-4 | 1/3.5 | 75 | 0.0 | No precipitate |
| 6-5 | 6-5 | 1/3 | 75 | 0.0 | No precipitate |
| 6-6 | 6-6 | 1/2.5 | 75 | 0.0 | No precipitate |
| 6-7 | 6-7 | 1/2 | 75 | 0.0 | No precipitate |
| 6-8 | 6-8 | 1/1.5 | 75 | 0.2 | Very slight precipitates |
| 6-9 | 6-9 | 1/3 | 40 | 0.5 | Some precipitates |
| 6-10 | 6-10 | 1/3 | 50 | 0.2 | Very slight precipitate |
| 6-11 | 6-11 | 1/3 | 60 | 0.0 | No precipitate |
| 6-12 | 6-12 | 1/3 | 80 | 0.0 | No precipitate |
| 6-13 | 6-13 | 1/3 | 100 | 0.0 | No precipitate |
| 6-14 | 6-14 | 1/3 | 120 | 0.0 | No precipitate |
| 6-15 | 6-15 | 1/3 | 130 | 0.2 | Very slight precipitates |
| 6-16 | 6-16 | 1/3 | 150 | 0.4 | Very slight precipitates |

*expressed in terms of a ratio of a turning radius of the blade to a radius of the tank As is apparent from Table 6, it was proved that the ratio of the stirring blade radius to the tank radius of 1/4.0or more, and specifically 1/3.5to 1/2suitably resulted in enhanced effects of the invention and the stirring rate of 50 to 120 r.p.m., and specifically 60 to 100 r.p.m. resulted in further enhanced effects of the invention.

Example 7

Sample solutions Nos. 7-1 through 7-8 of a bleach-fixing kit part were prepared similarly to sample solution No. 1 of Example 1, except that as a stirring condition, a circulation system by using a circulation pump was employed in place of propeller stirring and the circulation rate was varied, as shown in Table 9. Similarly to Example 1, storage stability of sample solutions, i.e., occurrence of precipitation in the aged solutions and the residual silver were evaluated, and the results thereof are shown in Table 7.

TABLE 7

| Processing No. | Sample Solution | Circulation Rate (cycle/min) | Residual Silver ($mg/m^2$) | Storage Stability |
|---|---|---|---|---|
| 7-1 | 7-1 | 1.5 | 0.4 | Some Precipitates |
| 7-2 | 7-2 | 2.0 | 0.2 | Very slight precipitate |
| 7-3 | 7-3 | 2.5 | 0.0 | No precipitate |
| 7-4 | 7-4 | 3.0 | 0.0 | No precipitate |
| 7-5 | 7-5 | 4.0 | 0.0 | No precipitate |
| 7-6 | 7-6 | 4.5 | 0.0 | No precipitate |
| 7-7 | 7-7 | 5.5 | 0.2 | Very slight precipitate |
| 7-8 | 7-8 | 6.0 | 0.6 | Very slight precipitate |

As is apparent from Table 7, it was proved that when prepared at a circulation rate of 2.0 to 5.5 cycle/min, and specifically at 2.5 to 4.5 cycle/min, effects of the invention were suitably achieved. Herein, "1 cycle/min" refers to a flow rate at which the quantity equivalent to the tank volume is flown per minute.

Example 8

Sample solutions Nos. 8-1 through 8-8 of a bleach-fixing kit part were prepared similarly to sample solution No. 1 of Example 1, except that the amount of compound (A-1), which was expressed in terms of a molar ratio of compound (A-1) to iron (III) nitrate, was varied as shown in Table 8. Similarly to Example 1, storage stability of sample solutions, i.e., occurrence of precipitation in the aged solutions and the residual silver were evaluated, and the results thereof are shown in Table 8.

TABLE 8

| Processing No. | Sample Solution | Molar Ratio of (A-1) to Iron(III) Nitrate | Residual Silver ($mg/m^2$) | Storage Stability |
|---|---|---|---|---|
| 8-1 | 8-1 | 0.90 | 0.4 | Slight precipitate |
| 8-2 | 8-2 | 0.95 | 0.2 | Slight precipitate |
| 8-3 | 8-3 | 1.00 | 0.0 | No precipitate |
| 8-4 | 8-4 | 1.03 | 0.0 | No precipitate |
| 8-5 | 8-5 | 1.05 | 0.0 | No precipitate |
| 8-6 | 8-6 | 1.07 | 0.2 | No precipitate |
| 8-7 | 8-7 | 1.10 | 0.3 | No precipitate |
| 8-8 | 8-8 | 1.15 | 0.6 | Very slight precipitate |

As is apparent from Table 8, it was proved that the molar ratio of [S,S]-alkylenediamine-N,N'-disuccinic acid to the iron (III) salt of 1.00 to 1.10 resulted in more enhanced effects of the invention, and specifically, the range of 1.00 to 1.05 led to still more enhanced effects of the invention.

Example 9

Experiments were conducted similarly to sample solution No. 1 of Example 1, except that the iron (III) nitrate nona-hydrate used therein was replaced by an equimolar amount of iron (III) bromide or iron (III) chloride; and similar results were obtained.

Example 10

A silver halide color photographic material (color negative film) was prepared in accordance with the following procedure.

There were formed the following layers having composition as shown below on a 120 $\mu$m, subbed triacetyl cellulose film support to prepare a multi-layered color photographic material. The addition amount of each compound was represented in term of $g/m^2$, unless otherwise noted. The amount of silver halide or colloidal silver was converted to the silver amount and the amount of a sensitizing dye (denoted as "SD") was represented in mol/Ag mol.

| 1st Layer: Anti-Halation Layer | |
|---|---|
| Black colloidal silver | 0.16 |
| UV-1 | 0.30 |
| CM-1 | 0.12 |
| CC-1 | 0.03 |
| OIL-1 | 0.24 |
| Gelatin | 1.33 |

-continued

| 2nd Layer: Interlayer | |
|---|---|
| Silver iodobromide emulsion j | 0.10 |
| AS-1 | 0.12 |
| OIL-1 | 0.15 |
| Gelatin | 0.67 |
| **3rd Layer: Low-speed Red-Sensitive Layer** | |
| Silver iodobromide emulsion c | 0.053 |
| Silver iodobromide emulsion d | 0.11 |
| Silver iodobromide emulsion e | 0.11 |
| SD-1 | $2.2 \times 10^{-5}$ |
| SD-2 | $5.9 \times 10^{-5}$ |
| SD-3 | $1.2 \times 10^{-4}$ |
| SD-5 | $2.8 \times 10^{-4}$ |
| C-1 | 0.19 |
| CC-1 | 0.003 |
| OIL-2 | 0.096 |
| AS-2 | 0.001 |
| Gelatin | 0.44 |
| **4th Layer: Medium-speed Red-sensitive Layer** | |
| Silver iodobromide emulsion b | 0.28 |
| Silver iodobromide emulsion c | 0.34 |
| Silver iodobromide emulsion d | 0.50 |
| SD-1 | $1.8 \times 10^{-5}$ |
| SD-3 | $2.6 \times 10^{-4}$ |
| SD-5 | $2.8 \times 10^{-4}$ |
| C-1 | 0.74 |
| CC-1 | 0.081 |
| DI-1 | 0.020 |
| DI-4 | 0.008 |
| OIL-2 | 0.42 |
| AS-2 | 0.003 |
| Gelatin | 1.95 |
| **5th Layer: High-speed Red-Sensitive Layer** | |
| Silver iodobromide emulsion a | 1.45 |
| Silver iodobromide emulsion e | 0.076 |
| SD-1 | $2.3 \times 10^{-5}$ |
| SD-2 | $1.1 \times 10^{-4}$ |
| SD-3 | $2.3 \times 10^{-5}$ |
| C-2 | 0.087 |
| C-3 | 0.12 |
| CC-1 | 0.036 |
| DI-1 | 0.021 |
| DI-3 | 0.005 |
| OIL-2 | 0.15 |
| AS-2 | 0.004 |
| Gelatin | 1.40 |
| **6th Layer: Interlayer** | |
| F-1 | 0.03 |
| AS-1 | 0.18 |
| OIL-1 | 0.22 |
| Gelatin | 1.00 |
| **7th Layer: Low-speed Green-Sensitive Layer** | |
| Silver iodobromide emulsion c | 0.22 |
| Silver iodobromide emulsion e | 0.22 |
| SD-6 | $4.7 \times 10^{-5}$ |
| SD-7 | $2.6 \times 10^{-4}$ |
| SD-8 | $1.9 \times 10^{-4}$ |
| SD-9 | $1.1 \times 10^{-4}$ |
| SD-10 | $2.4 \times 10^{-5}$ |
| M-1 | 0.35 |
| CM-1 | 0.044 |
| DI-2 | 0.010 |
| OIL-1 | 0.41 |
| AS-2 | 0.001 |
| AS-3 | 0.11 |
| Gelatin | 1.29 |

-continued

| 8th Layer: Medium-speed Green-Sensitive Layer | |
|---|---|
| Silver iodobromide emulsion b | 0.90 |
| Silver iodobromide emulsion e | 0.048 |
| SD-6 | $3.8 \times 10^{-5}$ |
| SD-7 | $2.6 \times 10^{-5}$ |
| SD-8 | $3.4 \times 10^{-4}$ |
| SD-9 | $1.6 \times 10^{-4}$ |
| SD-10 | $4.4 \times 10^{-5}$ |
| M-1 | 0.15 |
| CM-1 | 0.062 |
| CM-2 | 0.030 |
| DI-2 | 0.032 |
| OIL-1 | 0.28 |
| AS-2 | 0.005 |
| AS-3 | 0.045 |
| Gelatin | 1.00 |
| **9th Layer: High-speed Green-Sensitive Layer** | |
| Silver iodobromide emulsion a | 1.39 |
| Silver iodobromide emulsion e | 0.073 |
| SD-6 | $4.1 \times 10^{-5}$ |
| SD-7 | $2.6 \times 10^{-5}$ |
| SD-8 | $3.7 \times 10^{-4}$ |
| SD-10 | $4.9 \times 10^{-5}$ |
| M-1 | 0.071 |
| M-2 | 0.073 |
| CM-2 | 0.013 |
| DI-2 | 0.004 |
| DI-3 | 0.003 |
| OIL-1 | 0.27 |
| AS-2 | 0.008 |
| AS-3 | 0.043 |
| Gelatin | 1.35 |
| **10th Layer: Yellow Filter Layer** | |
| Yellow colloidal silver | 0.053 |
| AS-1 | 0.15 |
| OIL-1 | 0.18 |
| X-1 | 0.06 |
| Gelatin | 0.83 |
| **11th Layer: Low-speed Blue-sensitive Layer** | |
| Silver iodobromide emulsion g | 0.22 |
| Silver iodobromide emulsion h | 0.099 |
| Silver iodobromide emulsion i | 0.17 |
| SD-11 | $2.4 \times 10^{-4}$ |
| SD-12 | $5.7 \times 10^{-4}$ |
| SD-13 | $1.3 \times 10^{-4}$ |
| Y-1 | 1.02 |
| OIL-1 | 0.42 |
| AS-2 | 0.003 |
| X-1 | 0.11 |
| X-2 | 0.18 |
| Gelatin | 1.95 |
| **12th Layer: High-sped Blue-sensitive Layer** | |
| Silver iodobromide emulsion f | 1.52 |
| SD-11 | $8.3 \times 10^{-5}$ |
| SD-12 | $2.3 \times 10^{-4}$ |
| Y-1 | 0.22 |
| DI-5 | 0.11 |
| OIL-1 | 0.13 |
| AS-2 | 0.003 |
| X-1 | 0.15 |
| X-2 | 0.20 |
| Gelatin | 1.20 |
| **13th Layer: First Protective Layer** | |
| Silver iodobromide emulsion j | 0.30 |
| UV-1 | 0.11 |
| UV-2 | 0.055 |
| Liquid paraffin | 0.28 |
| X-1 | 0.079 |
| Gelatin | 1.00 |

-continued

| 14th Layer: Second protective Layer | |
|---|---|
| PM-1 | 0.13 |
| PM-2 | 0.018 |
| WAX-1 | 0.021 |
| Gelatin | 0.55 |

Characteristics of silver iodobromide emulsions a through j described above are shown below, in which the average grain size refers to an edge length of a cube having the same volume as that of the grain.

| Emulsion | Av. grain size (μm) | Av. AgI content (mol %) | Diameter/thickness ratio |
|---|---|---|---|
| a | 0.85 | 4.2 | 7.0 |
| b | 0.70 | 4.2 | 6.0 |
| c | 0.50 | 4.2 | 5.0 |
| d | 0.38 | 8.0 | Octahedral, twinned |
| e | 0.27 | 2.0 | Tetradehedral, twinned |
| f | 1.00 | 8.0 | 4.5 |
| g | 0.74 | 3.5 | 6.2 |
| h | 0.44 | 4.2 | 6.1 |
| i | 0.30 | 1.9 | 5.5 |
| j | 0.03 | 2.0 | 1.0 |

The foregoing emulsions a through i were each chemically sensitized by adding the foregoing sensitizing dyes to each of the emulsions and then by adding triphenylphosphine selenide, sodium thiosulfate, chloroauric acid and potassium thiocyanate according to the commonly known procedure until the relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1. As liquid paraffin was used Merck Index 117139 (available from Merck Co.).

The chemical structures of the compounds used in the photographic material sample are shown below.

Y-1
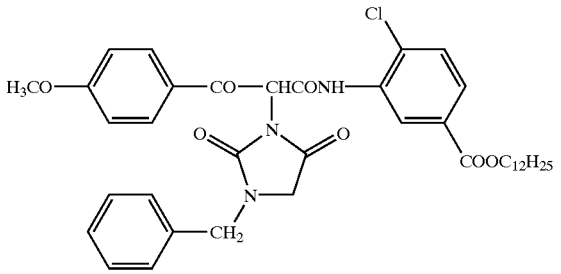
M-1
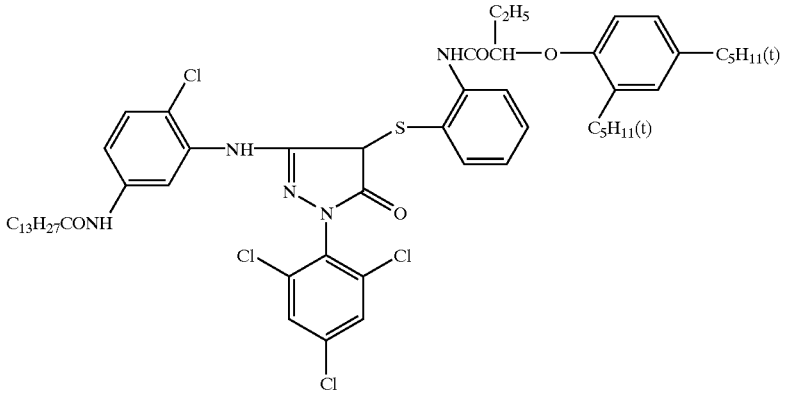
M-2
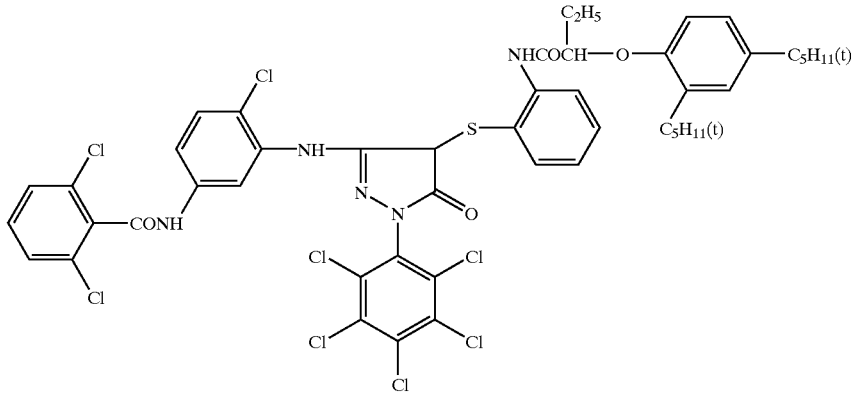
C-1
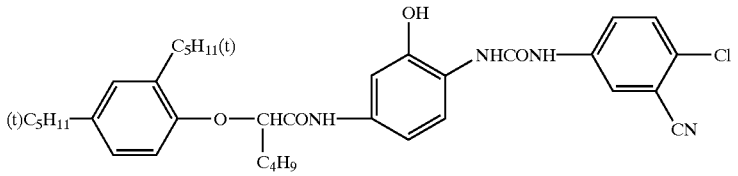
C-2
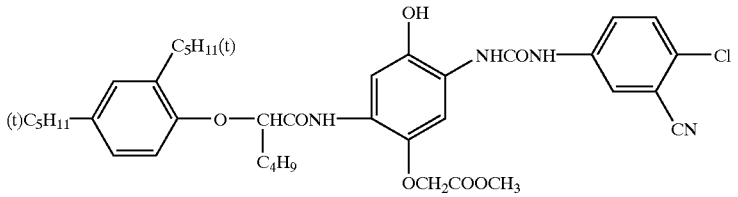

-continued
C-3
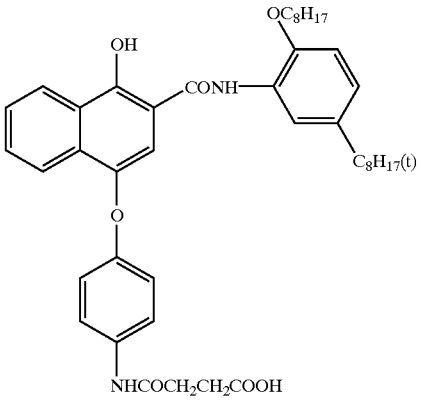
CC-1
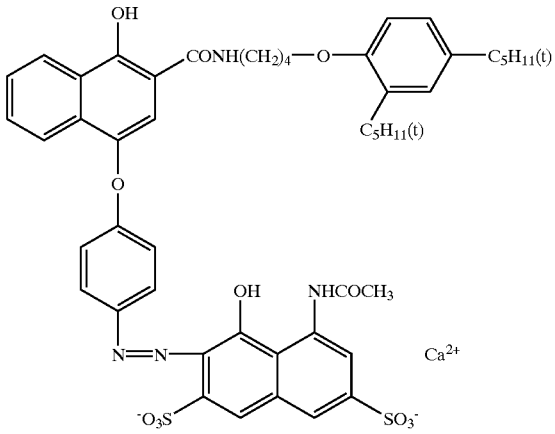
CM-1
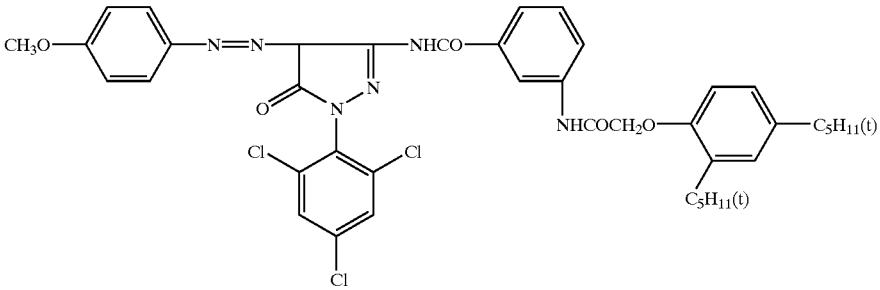
CM-2
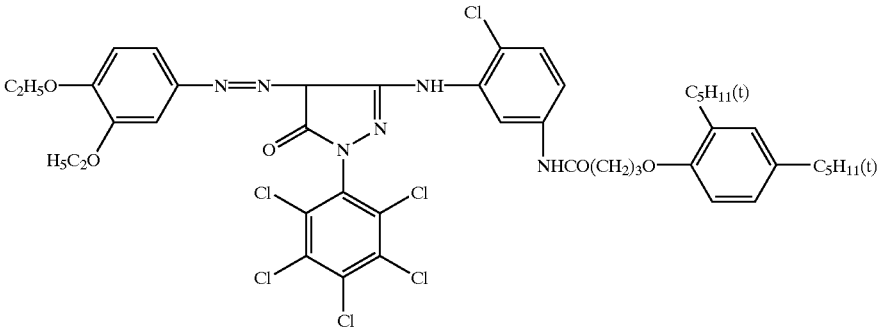
DI-1
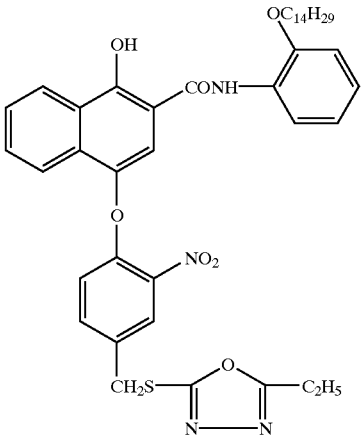
DI-2
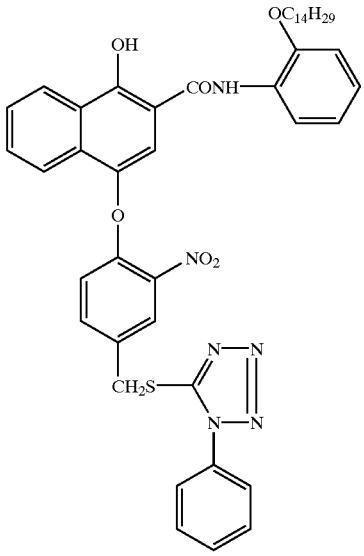

-continued
DI-3
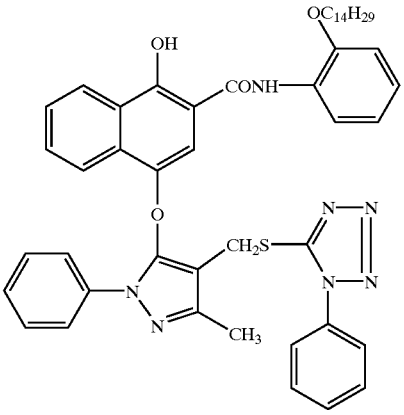
DI-4
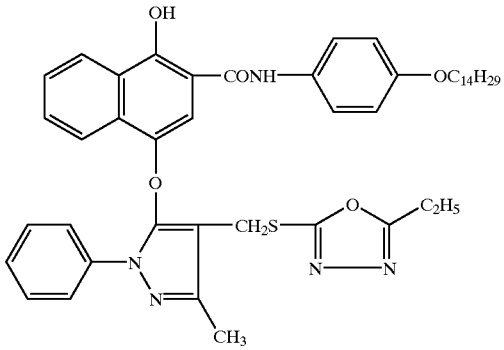
DI-5
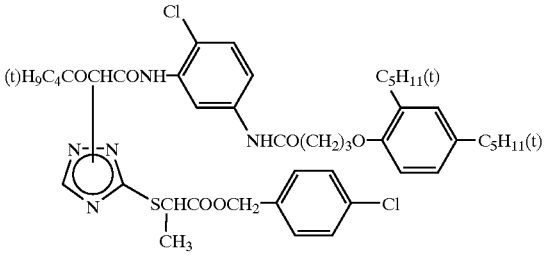
AS-1
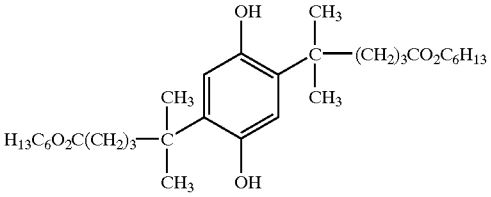
AS-2
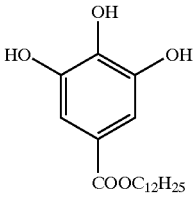
AS-3
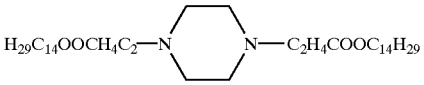
OIL-1
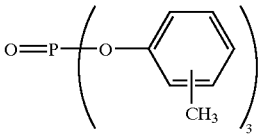
UV-1
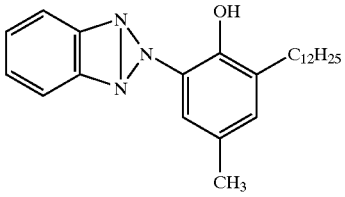
OIL-2
$H_9C_4OOC(CH_2)_8COOC_4H_9$
UV-2
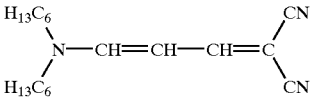
V-1
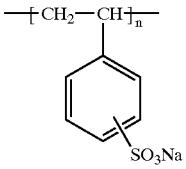
n: Degree of polymerization
Ase-1 (Mixture)
A
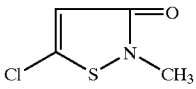
B
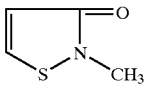

-continued
C
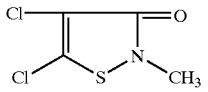
A:B:C = 50:46:4 (molar ratio)
H-1
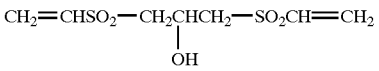
H-2
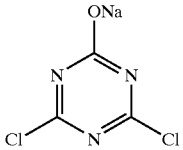
SD-1
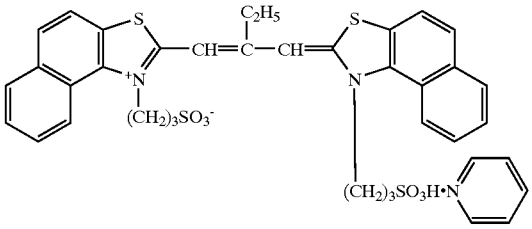
SD-2
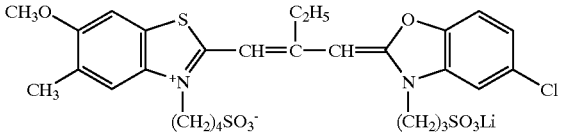
SD-3
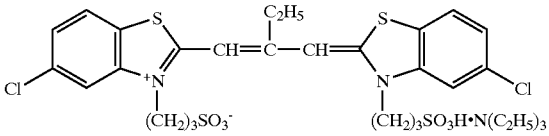
SD-5
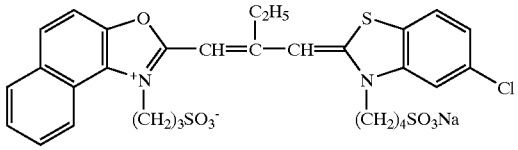
SD-6
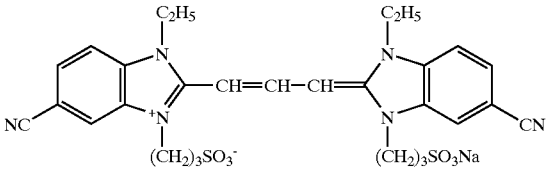
SD-7
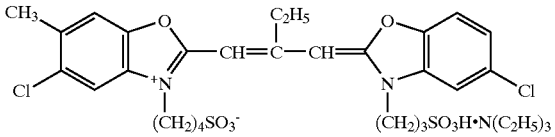
SD-8
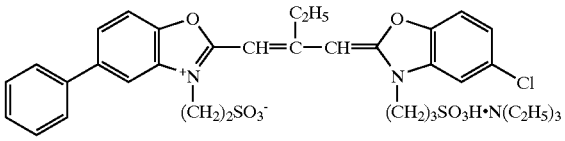
SD-9
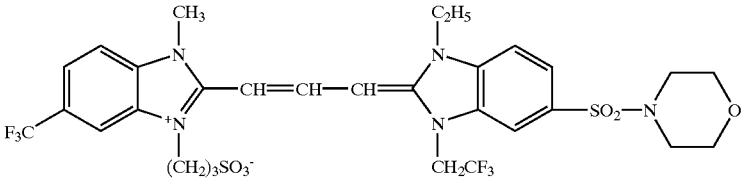
SD-10
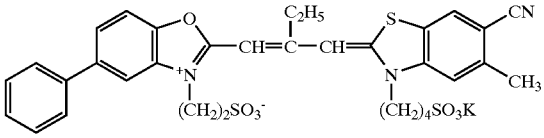
SD-11
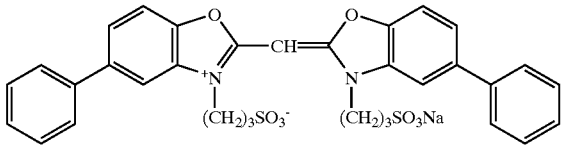

-continued
SD-12
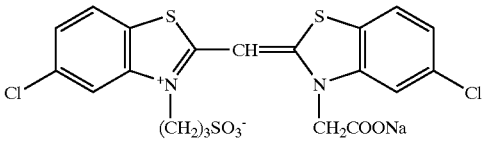
SD-13
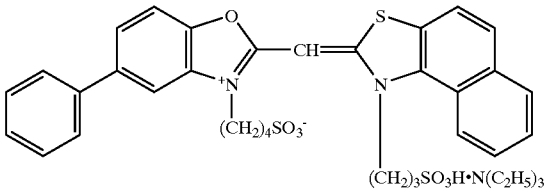
F-1
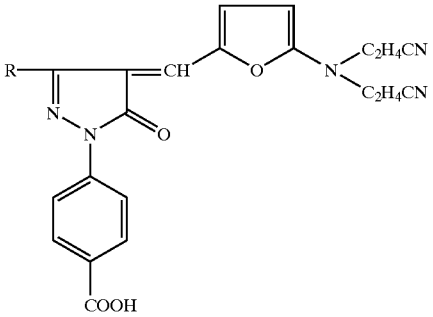
R: —— $CH_3$:CN (6:4)
Mixture (molar ratio)
ST-1
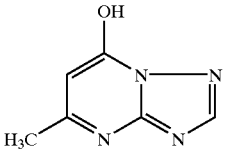
ST-2
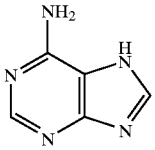
AF-1,2
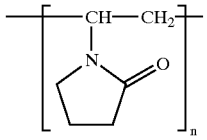
AF-1 Mw ≈ 10,000
AF-2 Mw ≈ 100,000
n: Degree of polymerization
AF-3
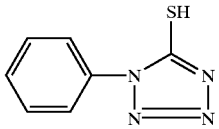
AF-4
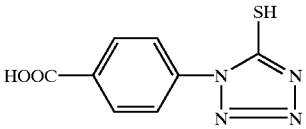
AF-5
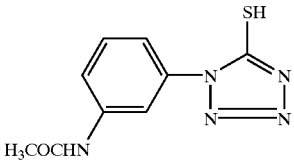
X-1
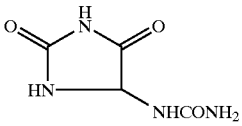
X-2
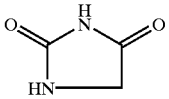
SU-1
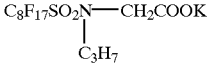
SU-2
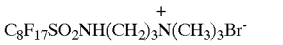
SU-3
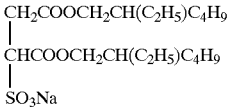
SU-4
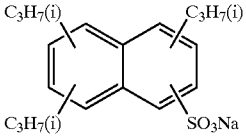
WAX-1
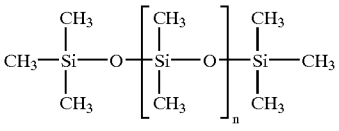
Mw = 3,000

-continued

PM-1

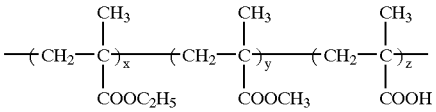

x:y:z = 3:3:4

PM-2

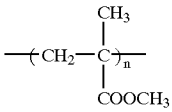

n: Degree of polymerization

Preparation of Bleaching Solution Kit

Sample solutions B1 to B4 as a bleaching solution kit were prepare similarly to sample solution No. 1 of Example 1, except that 8-kg of ammonium bromide was added and the pH was adjusted to 3.5 using 90% acetic acid.

Processing

Using each of the foregoing sample solutions, photographic processing was conducted using the color negative film described above in accordance with the following processing steps and processing solutions.

Process

| Step | Time | Temperature |
|---|---|---|
| Color developing | 3 min. 15 sec | 41° C. |
| Bleaching | 30 sec. | 38° C. |
| Fixing-1 | 45 sec. | 38° C. |
| Fixing-2 | 45 sec. | 38° C. |
| Stabilizing-1 | 20 sec. | 38° C. |
| Stabilizing-2 | 20 sec. | 38° C. |
| Stabilizing-3 | 20 sec. | 38° C. |
| Drying | 90 sec. | 65° C. |

Formula of Processing Solution

| Color developing solution (for 1 lit.) | |
|---|---|
| Sodium sulfite | 5.0 g |
| Potassium carbonate | 45.0 g |
| Sodium diethylenetriaminepentaacetate | 4.0 g |
| Hydroxylamine sulfate | 3.0 g |
| Potassium bromide | 1.5 g |
| 2-Methylbenzimidazole | 0.1 g |
| Potassium iodide | 2.0 g |
| 4-Amino-3-methyl-N-ethyl-(β-hydroxyethyl)-aniline sulfate | 10.2 g |

Water was added to make 1 lit. and the pH was adjusted to 10.30 using potassium hydroxide or 50% sulfuric acid.

| Bleaching solution (for 1 lit.) | |
|---|---|
| Sample solution B1 to B4 (Table 16) | 500 ml |
| Water to make | 1 lit. |
| **Fixing solution (for 1 lit.)** | |
| Ammonium thiosulfate | 100 g |
| Sodium thiosulfate | 10 g |
| Sodium sulfite | 12 g |
| Disodium ethylenediaminetetraacetate | 2 g |

Water was added to make 1 lit. and the pH was adjusted to 7.5 using ammonia water or 50% sulfuric acid.

| Stabilizing solution (for 1 lit.) | |
|---|---|
| m-Hydroxybenzaldehyde | 1.5 g |
| Disodium ethylenediaminetetraacetate | 0.6 g |
| β-cyclodextrin | 0.2 g |
| Potassium carbonate | 0.2 g |

Water was added to make 1 lit. and the pH was adjusted to 8.0 using potassium hydroxide or 50% sulfuric acid.

Exposure and Processing

The above-described color negative film was exposed to light thorough an optical wedge in the usual manner and then processing 9-1 through 9-4 were each conducted according to the foregoing processing steps and using the foregoing processing solutions. The amount of residual silver in the maximum density area of each of the thus processed color negative film samples was determined in a manner similar to Example 1. After completion of processing, each of the sample solutions was sealed in a glass container and aged at 50° C. for 3 days. Thereafter, the solutions were visually observed with respect to occurrence of precipitation. The result thereof is shown in Table 9.

TABLE 9

| Processing No. | Bleach Sample Solution | Retained Silver ($mg/m^2$) | Storage Stability* | Remark |
|---|---|---|---|---|
| 9-1 | B-1 | 0.3 | No precipitate | Inv. |
| 9-2 | B-2 | 0.9 | Precipitate | Comp. |
| 9-3 | B-3 | 1.1 | Precipitate | Comp. |
| 9-4 | B-4 | 1.2 | Precipitate | Comp. |

*Presence/absence of precipitates produced in bleaching solution after being aged As is apparent from Table 9, it was proved that the use of the inventive sample solution (as a bleaching solution kit) resulted in a minimized retained-silver and no occurrence of precipitation in the aged bleaching solution.

What is claimed is:

1. A method for preparing a kit part of a bleach-fixing solution for use in silver halide color photographic materials comprising the steps of:

(a) adding a [S,S]-alkylenediamine-N,N'-disuccinic acid or its salt into a mixing tank to form a solution, and then (b) adding thereto at least one iron (III) salt selected from the group consisting of iron (III) nitrate, iron (III) chloride, iron (III) bromide, $(M_1)_3Fe(III)(SO_4)_3$ and $M_1Fe(III)(SO_4)_2$, in which $M_1$ represents a hydrogen, sodium or potassium or an ammonium, while stirring at a temperature of 35 to 80°C., wherein in the step (b), stirring is performed by propeller stirring or circulation stirring, wherein the propeller stirring is performed using a rotary blade having a turning radius of not less than ¼ of the radius of the mixing tank at a stirring rate of 50 to 120 r.p.m., and the circulation stirring being performed at a circulation rate 2.0 to 5.5 cycles/min.

2. The method of claim 1, wherein the [S,S]-alkylenediamine-N,N'-disuccinic acid is a compound represented by the following formula (A):

formula (A)

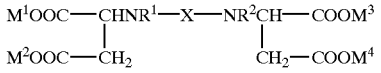

wherein $M^1$, $M^2$, $M^3$ and $M^4$ each represent a hydrogen atom, an alkali metal or a cation; X represents an alkylene group having 2 to 6 carbon atoms or $—(B_1O)_n—B_2—$, in which $B_1$ and $B_2$ each represent an alkylene group having 1 to 5 carbon atoms and n is an integer of 1 to 6; $R^1$ and $R^2$ each represent a hydrogen atom or an alkyl group having 1 to 3 carbon atoms.

3. The method of claim 1, wherein the solution formed in the step (a) has a pH of 6.0 to 10.0.

4. The method of claim 1, wherein the kit part of a bleach-fixing solution exhibits a pH of 3.5 to 6.0.

5. The method of claim 1, wherein in the step (b), the iron (III) salt is added while being stirred at a temperature of 40 to 70° C.

6. The method of claim 1, wherein the kit part of a bleach-fixing solution contains a compound represented by the following formula (1):

$$MOOC—(Z)_k—(X)_n \qquad \text{formula (1)}$$

wherein X represents $—COOM_2$, —OH, $—SO_3M_3$ or $—PO_3M_4M_5$, in which $M_2$ through $M_5$ each represent a hydrogen atom or alkali metal atom; n is an integer of 1 to 3, provided that when n is 2 or more, plural Xs may be the same or different; Z represents a linking group having 1 to 10 carbon atoms and comprising carbon and hydrogen atoms, or carbon, hydrogen and oxygen atoms; k is 0 or 1 and M is a hydrogen atom or alkali metal atom.

7. The method of claim 1, wherein the kit part of a bleach-fixing solution contains an alkylenediamine-N-monosuccinic acid or its salt.

8. The method of claim 7, wherein the alkylenediamine-N-monosuccinic acid is represented by the following formula (B):

formula (B)

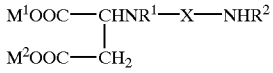

wherein $M^1$ and $M^2$ each represent a hydrogen atom, alkali metal atom or a cation; X represents an alkylene group having 2 to 6 carbon atoms or $—(B_1O)_n—B_2—$, in which $B_1$ and $B_2$ is an alkylene group having 1 to 5 carbon atoms and n is an integer of 1 to 6; $R^1$ and $R^2$ each represent a hydrogen atom or an alkyl group having 1 to 3 carbon atoms.

9. A method for preparing a kit of a bleaching solution for use in silver halide color photographic materials comprising the steps of:

(a) adding a [S,S]-alkylenediamine-N,N'-disuccinic acid or its salt into a mixing tank to form a solution, and then (b) adding thereto at least one iron (III) salt selected from the group consisting of iron (III) nitrate, iron (III) chloride, iron (III) bromide, $(M_1)_3Fe(III)(SO_4)_3$ and $M_1Fe(III)(SO_4)_2$, in which $M_1$ represents a hydrogen, sodium or potassium or an ammonium, while stirring at a temperature of 35 to 80° C., wherein in the step (b), stirring is performed by propeller stirring or circulation stirring, wherein the propeller stirring is performed using a rotary blade having a turning radius of not less than ¼ of the radius of the mixing tank at a stirring rate of 50 to 120 r.p.m., a d the circulation stirring being performed at a circulation rate f 2.0 to 5.5 cycles/min.

10. The method of claim 9, wherein the [S,S]-alkylenediamine-N,N'-disuccinic acid is a compound represented by the following formula (A):

formula (A)

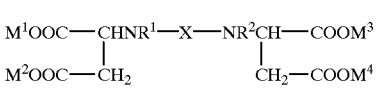

wherein $M^1$, $M^2$, $M^3$ and $M^4$ each represent a hydrogen atom, an alkali metal or a cation; X represents an alkylene group having 2 to 6 carbon atoms or $—(B_1O)_n—B_2—$, in which $B_1$ and $B_2$ each represent an alkylene group having 1 to 5 carbon atoms and n is an integer of 1 to 6; $R^1$ and $R^2$ each represent a hydrogen atom or an alkyl group having 1 to 3 carbon atoms.

11. The method of claim 9, wherein the solution formed in the step (a) has a pH of 6.0 to 10.0.

12. The method of claim 9, wherein the kit of a bleaching solution exhibits a pH of 3.5 to 6.0.

13. The method of claim 9, wherein in the step (b), the iron (III) salt is added while being stirred at a temperature of 40 to 70° C.

14. The method of claim 9, wherein the kit part of a bleaching solution contains a compound represented by the following formula (1):

$$MOOC—(Z)_k—(X)_n \qquad \text{formula (1)}$$

wherein X represents $—COOM_2$, —OH, $—SO_3M_3$ or $—PO_3M_4M_5$, in which $M_2$ through $M_5$ each represent a hydrogen atom or alkali metal atom; n is an integer of 1 to 3, provided that when n is 2 or more, plural Xs may be the same or different; Z represents a linking group having 1 to 10 carbon atoms and comprising carbon and hydrogen atoms, or carbon, hydrogen and oxygen atoms; k is 0 or 1 and M is a hydrogen atom or alkali metal atom.

15. The method of claim 9, wherein the kit of a bleaching solution contains an alkylenediamine-N-monosuccinic acid or its salt.

16. The method of claim 15, wherein the alkylenediamine-N-monosuccinic acid is represented by the following formula (B):

formula (B)

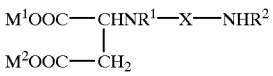

wherein $M^1$ and $M^2$ each represent a hydrogen atom, alkali metal atom or a cation; X represents an alkylene group having 2 to 6 carbon atoms or $—(B_1O)_n—B_2—$, in which $B_1$ and $B_2$ is an alkylene group having 1 to 5 carbon atoms and n is an integer of 1 to 6; $R^1$ and $R^2$ each represent a hydrogen atom or an alkyl group having 1 to 3 carbon atoms.

17. The method of claim 1, wherein the molar ratio of the of the [S,S]-alkylenediamine-N,N'-disuccinic acid or its salt to the iron (III) salt is 1.00 to 1.10.

18. The method of claim 9, wherein the molar ratio of the of the [S,S]-alkylenediamine-N,N'-disuccinic acid or its salt to the iron (III) salt is 1.00 to 1.10.

* * * * *